US008818237B2

(12) United States Patent
Lee et al.

(10) Patent No.: US 8,818,237 B2
(45) **Date of Patent: *Aug. 26, 2014**

(54) IMAGE FORMING APPARATUS AND STRUCTURE FOR INSTALLING CONSUMABLES THEREOF

(71) Applicant: Samung Electronics Co., Ltd., Suwon-si (KR)

(72) Inventors: Byung-jo Lee, Bucheon-si (KR); Jin-ho Park, Yongin-si (KR); Kwoang-joe Seorl, Yongin-si (KR); Gun-wook Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/075,724

(22) Filed: Nov. 8, 2013

(65) Prior Publication Data

US 2014/0064780 A1 Mar. 6, 2014

Related U.S. Application Data

(63) Continuation of application No. 12/923,620, filed on Sep. 29, 2010, now Pat. No. 8,606,146.

(30) Foreign Application Priority Data

Apr. 15, 2010 (KR) ..... 10-2010-0035033

(51) Int. Cl.
*G03G 15/04* (2006.01)

(52) U.S. Cl.
USPC ..... 399/119

(58) Field of Classification Search
USPC ..... 399/12, 13, 111, 119
See application file for complete search history.

(56) References Cited

U.S. PATENT DOCUMENTS

| | | | |
|---|---|---|---|
| 7,021,729 | B2 | 4/2006 | Mansueto |
| 2005/0281591 | A1 | 12/2005 | Kitozaki et al. |
| 2006/0169067 | A1 | 8/2006 | Yoshizawa |
| 2007/0189781 | A1 | 8/2007 | Katogi et al. |
| 2007/0286646 | A1 | 12/2007 | Ichikawa et al. |

FOREIGN PATENT DOCUMENTS

| | | |
|---|---|---|
| EP | 0 571 767 | 12/1993 |
| EP | 0895137 A1 | 2/1999 |

(Continued)

OTHER PUBLICATIONS

Extended European Search Report dated Jan. 2, 2012 issued in corresponding European Patent Application No. 10189096.0.
U.S. Office Action issued Oct. 1, 2012 in copending U.S. Appl. No. 12/923,620.

(Continued)

*Primary Examiner* — Gregory H Curran
(74) *Attorney, Agent, or Firm* — Staas & Halsey LLP

(57) ABSTRACT

A structure for installing consumables of an image forming apparatus, the structure comprising: a frame; a plurality of consumables which comprises irregular installation preventing units in different locations; a plurality of irregular installation preventing keys which prevents an irregular installation of the plurality of consumables by an interaction with the irregular installation preventing units; and an installation guide member which is installed in the frame, comprising a key installation unit to guide the plurality of irregular installation preventing keys to be installed differently for each of the consumables and having the plurality of consumables installed therein.

19 Claims, 9 Drawing Sheets

(56) References Cited

FOREIGN PATENT DOCUMENTS

| | | | |
|---|---|---|---|
| EP | 1607802 | A2 | 12/2005 |
| EP | 1933207 | A1 | 6/2008 |
| EP | 2023215 | A1 | 2/2009 |
| JP | 1-147565 | | 6/1989 |
| JP | 9-166952 | | 6/1997 |
| JP | 2007-139835 | | 6/2007 |
| JP | 2009-98409 | | 5/2009 |
| WO | 2006/090901 | A1 | 8/2006 |

OTHER PUBLICATIONS

U.S. Office Action issued Feb. 26, 2013 in copending U.S. Appl. No. 12/923,620.

U.S. Office Action issued Apr. 22, 2013 in copending U.S. Appl. No. 12/923,620.

U.S. Notice of Allowance issued Aug. 8, 2013 in copending U.S. Appl. No. 12/923,620.

U.S. Appl. No. 12/923,620, filed Sep. 29, 2010, Byung-jo Lee, Samsung Electronics Co., Ltd.

Chinese Office Action issued Apr. 3, 2014 in corresponding Chinese Application No. 201110091687.0.

IMAGE FORMING APPARATUS AND STRUCTURE FOR INSTALLING CONSUMABLES THEREOF

CROSS-REFERENCE TO RELATED APPLICATIONS

This application is a continuation of U.S. application Ser. No. 12/923,620 filed on Sep. 29, 2010, which claims priority from Korean Patent Application No. 10-2010-0035033, filed on Apr. 15, 2010 in the Korean Intellectual Property Office, the disclosures of which are incorporated herein by reference.

BACKGROUND

1. Field

Apparatuses consistent with the exemplary embodiments relate to an image forming apparatus forming an image on a print medium and a structure for installing consumables thereof, and more particularly, to an image forming apparatus and a structure for installing consumables thereof which prevents an irregular installation of consumables such as a developing unit and a developing cartridge.

2. Description of the Related Art

An image forming apparatus such as a printer, a photocopier, a facsimile, or a multi-function device forms an image on a print medium by an electrophotograhic, inkjet or thermal transfer method. In particular, a color image forming apparatus includes a plurality of developing units in each color to form a plurality of color images, e.g., yellow (Y), magenta (M), cyan (C) and black (K) images. The color image forming apparatus further includes a developing cartridge which is separate from the developing unit and supplies developers in each color corresponding to the developers.

The developing unit and the developing cartridge are representative consumables among components of the image forming apparatus. The developing unit and the developing cartridge are detachably coupled to a main body of the image forming apparatus. Toner consumables which apply to the color image forming apparatus have the same or similar shapes in a plurality of colors and are likely to be irregularly assembled at an initial assembly process or irregularly replaced by a new consumable by a user.

If different types of irregular installation preventing structures are provided in each color in order to prevent irregular installation of consumables, molds should be additionally provided to manufacture consumables in each color, thereby increasing manufacturing costs.

If an irregular installation preventing structure is provided in a front end in an installation direction of consumables, consumables may fall off and be damaged when irregularly installed. On the contrary, if the irregular installation preventing structure is provided in a rear end in the installation direction of consumables, the rear end part may be damaged due to a forced insertion.

SUMMARY

Accordingly, one or more exemplary embodiments provide a structure for installing consumables of an image forming apparatus and an image forming apparatus applying the same which employs an irregular installation preventing key manufactured by a single mold.

Further, one or more exemplary embodiments provides a structure for installing consumables of an image forming apparatus and an image forming apparatus applying the same which employs an irregular installation preventing structure in consideration of the center of gravity of consumables.

The foregoing and/or other aspects may be achieved by providing a structure for installing consumables of an image forming apparatus, the structure including: a frame; a plurality of consumables which includes irregular installation preventing units in different locations; a plurality of irregular installation preventing keys which prevents an irregular installation of the plurality of consumables by an interaction with the irregular installation preventing units; and an installation guide member which is installed in the frame, includes a key installation unit to guide the plurality of irregular installation preventing keys to be installed differently for each of the consumables and has the plurality of consumables installed therein.

The plurality of irregular installation preventing keys may have the same shape, and may differ in an irregular installation preventing location depending on an installation direction of the irregular installation preventing keys with respect to the key installation unit.

The key installation unit may include an installation hole formed in the installation guide member in a transverse direction of an installation direction of the consumables; and a regulator which is formed in different locations of the installation guide member for each of the plurality of consumables and regulates an installation direction of the irregular installation preventing keys.

The key installation unit may include an identification unit which is formed in a surface of the installation guide member in which the irregular installation preventing keys are installed, and identifies an installation direction of the irregular installation preventing keys for the plurality of consumables.

The irregular installation preventing keys may include a stopper which inserted in the installation hole avoiding the regulator and formed on a surface of the installation guide member in which the consumables are installed, and prevents an irregular installation of the plurality of consumables.

The plurality of consumables may include a plurality of developing units which is classified by color and differs in an installation location or a plurality of developing cartridges which is classified by color and differs in an installation location.

A plurality of cores which is formed in different locations corresponding to the irregular installation preventing unit may be used to form a housing of the plurality of developing units or a housing of the plurality of developing cartridges by a single mold.

An installation location of the irregular installation preventing unit with respect to the consumables and an installation location of the key installation unit with respect to the installation guide member may be determined to enable the irregular installation preventing unit and the irregular installation preventing keys to interact after the center of gravity of the plurality of consumables is located on the installation guide member.

Another aspect is achieved by providing an image forming apparatus including: a frame; a plurality of developing units which includes an irregular installation preventing unit in different locations and forms a visible image on an image carrier; a plurality of irregular installation preventing keys which prevents an irregular installation of the plurality of developing units by an interaction with the irregular installation preventing unit; and an installation guide member which is installed in the frame, includes a key installation unit guiding the plurality of irregular installation preventing keys to be installed differently for each of the developing units and has the plurality of developing units installed therein.

The plurality of irregular installation preventing keys may have the same shape, and may differ in an irregular installation preventing location depending on the installation direction of the irregular installation preventing keys with respect to the key installation unit.

The key installation unit may include an installation hole which is formed in the installation guide member in a transverse direction of the installation direction of the developing unit, and a regulator which is formed in different locations of the installation guide member for each of the plurality of developing units and regulates the installation direction of the irregular installation preventing keys.

The key installation unit may include an identification unit which is formed in a surface of the installation guide member in which the irregular installation preventing keys are installed, and identifies the installation direction of the irregular installation preventing keys for each of the plurality of developing units.

The irregular installation preventing keys may include a stopper which is inserted into the installation hole avoiding the regulator and formed on a surface of the installation guide member in which the developing units are installed, and prevents the irregular installation of the plurality of developing units.

A plurality of cores which is formed in different locations corresponding to the irregular installation preventing unit may be used to form a housing of the plurality of developing units by a single mold.

The installation location of the irregular installation preventing unit with respect to the developing unit and the installation location of the key installation unit with respect to the installation guide member may be determined to enable the irregular installation preventing unit and the irregular installation preventing keys to interact after the center of gravity of the plurality of developing units is located in the installation guide member.

Still another aspect is achieved by providing a developing cartridge to be installed in a structure where a plurality of irregular installation preventing keys that have the same shape and differ in location are provided, the developing cartridge including: a housing; and an irregular installation preventing unit which is installed in the housing and prevents irregular installation of the developing cartridge by interaction with one of the plurality of irregular installation preventing keys.

The developing cartridge may include a plurality of developing cartridges which is classified by color and differs in an installation location.

A plurality of cores which is formed in different locations corresponding to the irregular installation preventing unit may be used to form the housing of the plurality of developing cartridges by a single mold.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION

Figure 1:
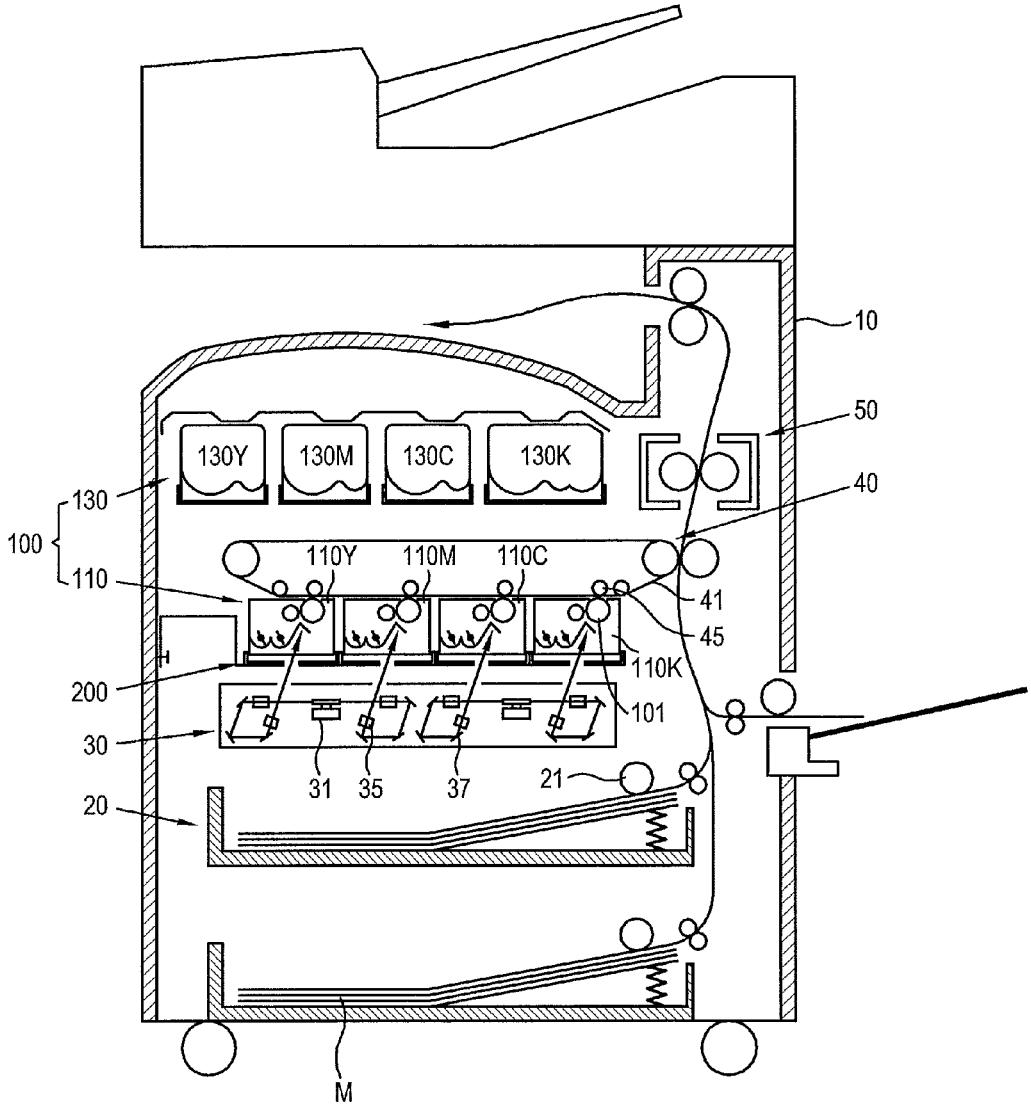
FIG. 1 is a schematic sectional view of an image forming apparatus according to an exemplary embodiment.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

FIG. 1 is a schematic sectional view of an image forming apparatus according to an exemplary embodiment.

Referring to FIG. 1, the image forming apparatus according to the exemplary embodiment is a tandem color image forming apparatus which forms a color image by a single path imaging process. The image forming apparatus includes a developing unit 110 including an image carrier 101, a light scanning unit 30, a transfer unit 40 and a fusing unit 50. A supply unit 20 in which a print medium M is stored is detachably attached to an inside of a housing 10 forming an external appearance of the image forming apparatus. The print medium M stored in the supply unit 20 is picked up by a pickup roller 21 and then transferred to the transfer unit 40 through a transfer path.

The image carrier 101 forms a latent image in each color by responding to a light beam scanned by the light scanning unit 30. In the present exemplary embodiment, first to fourth image carriers which are arranged in order from a supply direction of the print medium M are provided as an example of the plurality of image carriers 101.

The developing unit 110 accommodates therein a toner supplied by the developing cartridge 130, and forms a toner image on the image carrier 101. The developing unit 110 may be plurally provided per color. As an example of the developing unit 110, FIG. 1 illustrates an example of first to fourth developing units 110Y, 110M, 110C and 110K to embody yellow, magenta, cyan and black colors. In this case, the developing cartridge 130 includes first to fourth developing cartridges 130Y, 130M, 130C and 130K in line with the developing units in each color.

In the present exemplary embodiment, the developing unit 110 and the developing cartridge 130 are provided separately, but not limited thereto. Alternatively, the developing unit 110 and the developing cartridge 130 may be provided as a single body. In the present exemplary embodiment, the image carrier 101 is provided in the developing unit 110 but not limited thereto. Alternatively, the image carrier 101 may be provided in an external part of the developing unit 110.

The developing unit 110 and the developing cartridge 130 are representative consumables 100 relating to a toner of the image forming apparatus. If a developer which is accommodated in the developing cartridge 130 is consumed or the life of the developer 110 expires, such developing cartridge 130 or developing unit 110 should be replaced by new ones in each color. As the consumables 100 have the same or similar housing structures, they may be irregularly replaced or installed during a manufacturing process of the image forming apparatus. Detailed description of the structure for installing consumables according to the exemplary embodiment of the present invention will be described later.

The light scanning unit 30 scans light to the plurality of image carriers 101 to form a latent image thereon. The light scanning unit 30 includes a light source (not shown), a beam deflector 31 which deflects and scans light emitted from the light source, an f-θ lens 35 focusing the light beam deflected by the beam deflector 31 on the image carrier 101 and a reflection member 37 which converts a moving path of light scanned by the beam deflector 31.

The transfer unit 40 transfers a visible image formed in the image carrier 110 to the print medium M supplied along a print path. The transfer unit 40 may include a transfer belt 41 and a transfer backup roller 45 which face the plurality of image carriers 101. An image which is transferred to the print medium M through the transfer unit 40 is fused by the fusing unit 40.

Figure 2:
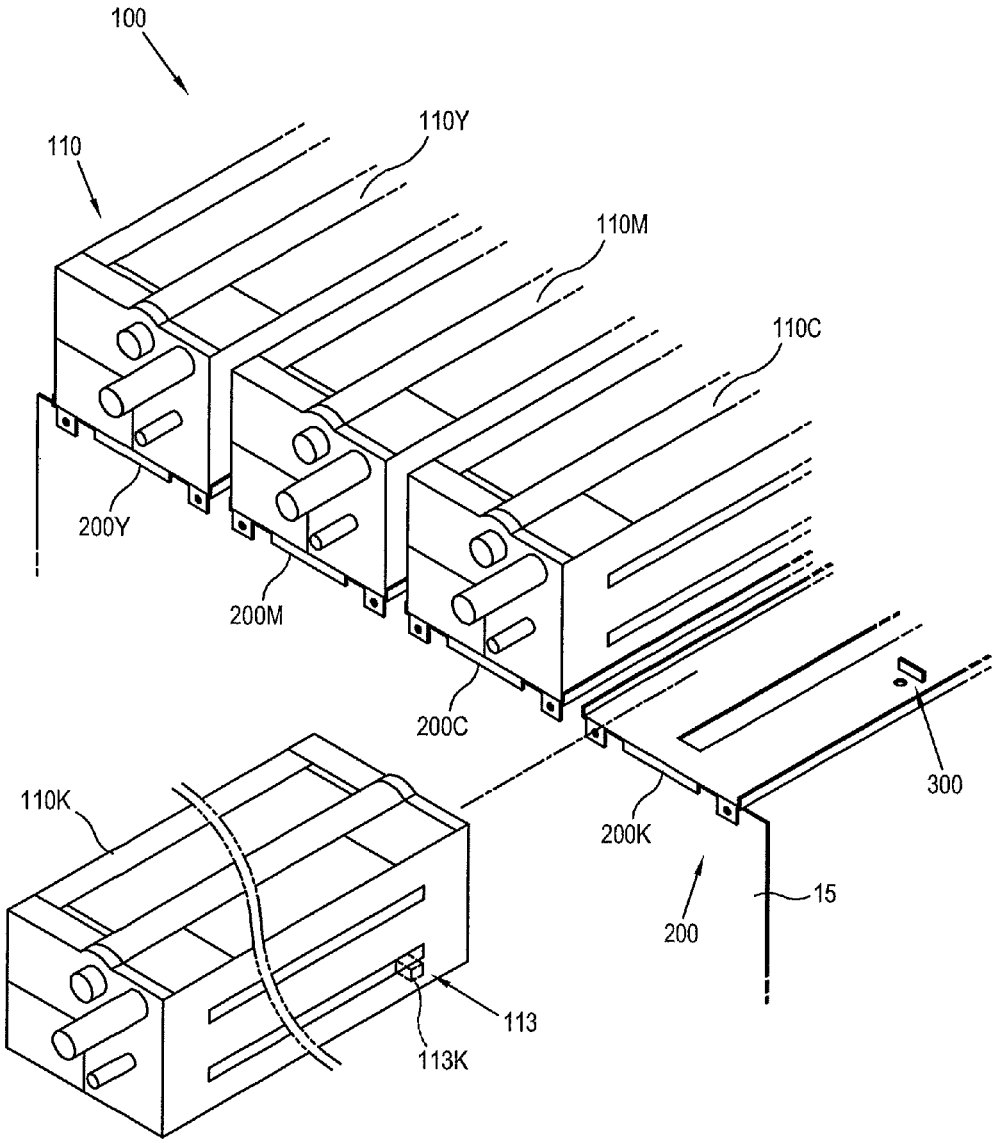
FIG. 2 is a partial perspective view of a structure for installing consumables of the image forming apparatus according to the exemplary embodiment.
Figure 3:
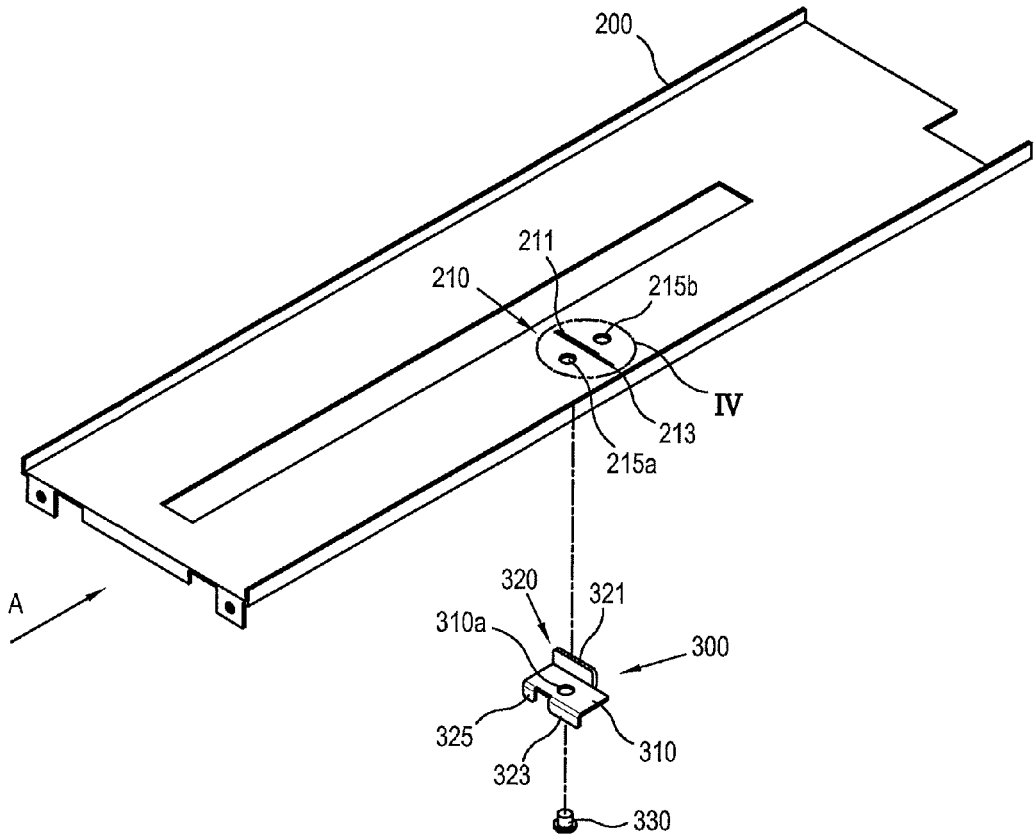
FIG. 3 is a decoupled perspective view illustrating a coupling relationship between an installation guide member and an irregular installation preventing key in FIG. 2.
Figure 4A:
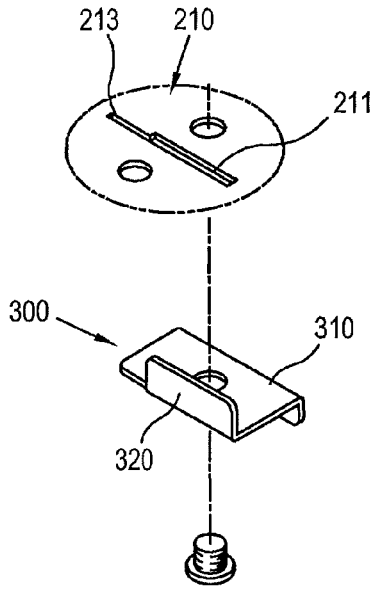
FIGS. 4A to 4D are enlarged views of an area IV in FIG. 3 illustrating a coupling relationship between a key installation unit formed in the installation guide member and the irregular installation preventing key in each color.
Figure 4B:
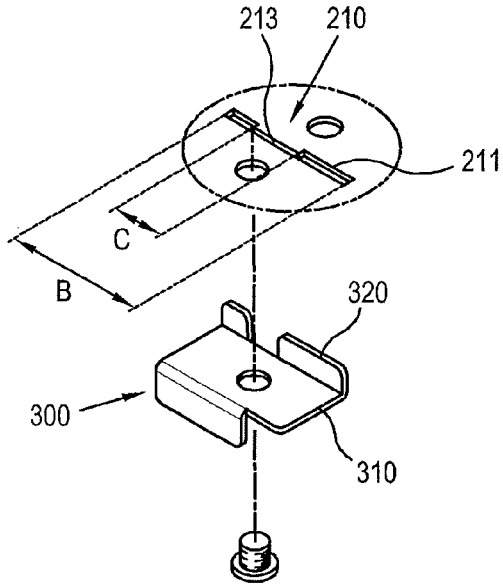
Figure 4C:
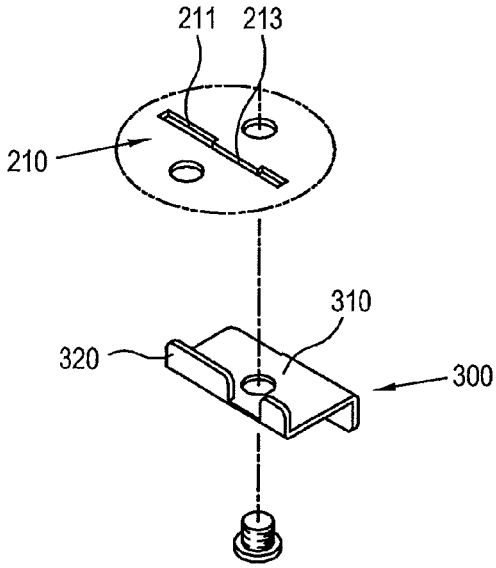
Figure 4D:
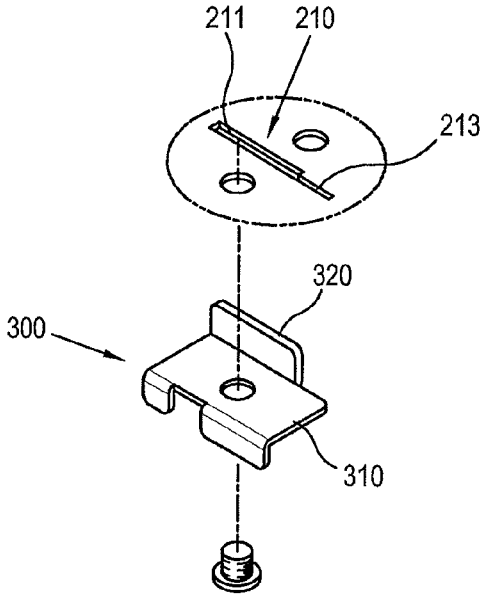
Figure 5A:
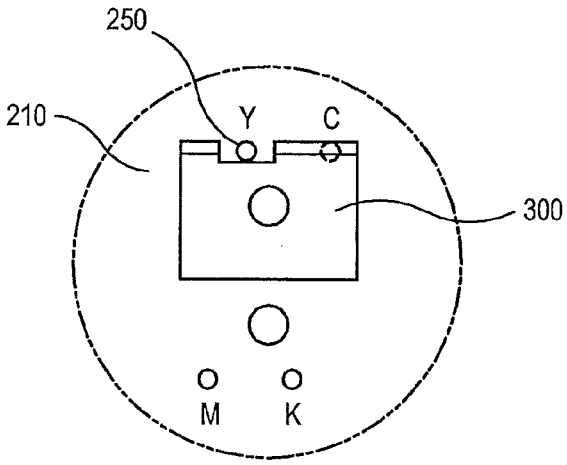
FIGS. 5A to 5D are rear enlarged views of the area IV in FIG. 3 illustrating the coupling relationship between the key installation unit formed in the installation guide member and the irregular installation preventing key in each color.
Figure 5B:
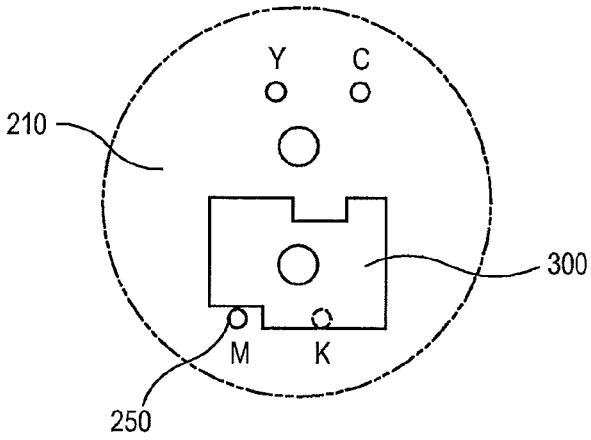
Figure 5C:
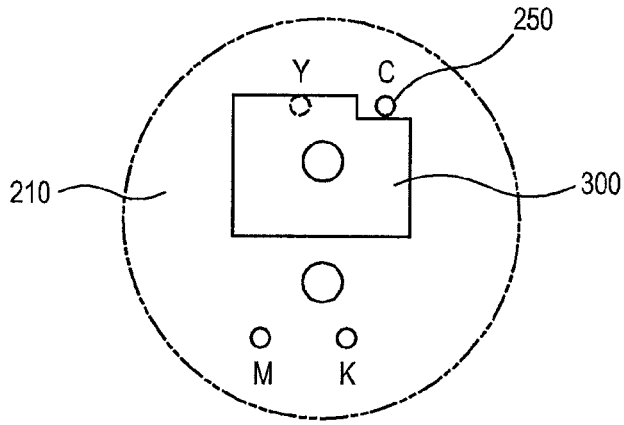
Figure 5D:
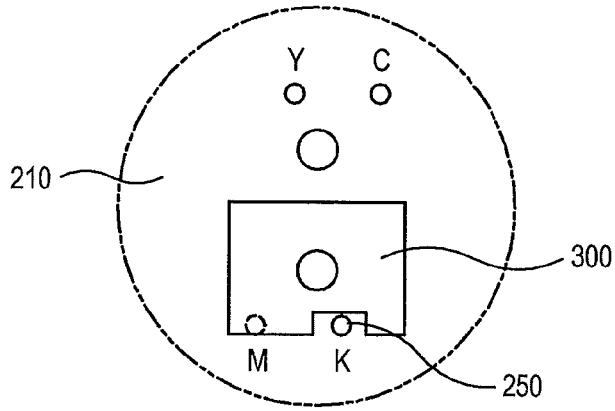

FIG. 2 is a partial perspective view of a structure for installing consumables of the image forming apparatus according to the exemplary embodiment. FIG. 3 is a decoupled perspective view illustrating a coupling relationship between the installation guide member and the irregular installation preventing key in FIG. 2.

Referring to FIGS. 2 and 3, the structure for installing consumables of the image forming apparatus according to the exemplary embodiment of the present invention includes a frame 15 provided in the housing 10, an installation guide member 200 guiding the installation of a plurality of consumables 100 and an irregular installation preventing key 300.

In the present exemplary embodiment, the developing unit 110 in FIG. 1 is an example of the plurality of consumables 100. The developing unit 110 includes an irregular installation preventing units 113 which is formed in a lower surface facing the installation guide member 200. The irregular installation preventing units 113 are formed in different locations per color and prevent an irregular installation of the developing unit 110 by an interaction with the irregular installation preventing keys 300. The installation guide member 200 includes a key installation unit 210 which guides the plurality of irregular installation preventing keys 300 to be installed differently for each of the consumables 100. The plurality of installation guide members 200 includes first to fourth installation guide members 200Y, 200M, 200C and 200K in which first to fourth developing units 110Y, 110M, 110C and 110K are installed, respectively. The first to fourth developing units 110Y, 110M, 110C and 110K are slidably coupled in a direction A in FIG. 2 to the first to fourth installation guide members 200Y, 200M, 200C and 200K. Upon coupling slidably, irregular installation is prevented by an interaction between the irregular installation preventing units 113 and the irregular installation preventing keys 300.

FIGS. 4A to 4D are enlarged views of an area IV in FIG. 3 illustrating a coupling relationship between the key installation unit 210 formed in the installation guide members 200 and the irregular installation preventing keys 300. Referring to FIGS. 4A to 4D, a plurality of irregular installation preventing keys 300Y, 300M, 300C and 300K which is installed in the key installation unit 210 of the first to fourth installation guide members 200Y, 200M, 200C and 200K have the same shape. The plurality of irregular installation preventing keys 300Y, 300M, 300C and 300K differs in an irregular installation preventing location depending on the installation direction with respect to the key installation unit 210.

Referring to FIG. 3, the key installation unit 210 includes an installation hole 211 which is formed in the installation guide members 200 in a transverse direction of an installation direction A of the consumables 100, and a regulator 213 which regulates the installation direction of the irregular installation preventing keys 300. As shown in FIGS. 4A to 4D, the regulator 213 is formed in different locations of the installation guide members 200 for the plurality of consumables 100 and regulates the installation direction of the irregular installation preventing keys 300 in each color. That is, the regulator 213 is formed so that the irregular installation preventing keys 300 are installed in four modes in order to identify the installation location of the first to fourth developing units 110Y, 110M, 110C and 110K.

Assuming that a length of the installation hole 211 is B, a width (C) of the regulator 213 in the same direction is approximately B/4 and the regulator 213 is formed in different locations in each color.

The irregular installation preventing keys 300 include a coupler 310 which is coupled to another surface of the installation guide members 200 to be in parallel with the plate surface of the installation guide members 200, and a stopper 320 which is formed on a surface of the installation guide members 200. The coupler 310 may be coupled to the another surface of the installation guide members 200 by screw, rivet, adhesives or welding. In the present exemplary embodiment, the coupler 310 is coupled to the installation guide members 200 by a rivet between a first coupling groove 310 formed in the coupler 310 and a second coupling groove 215*a* or a third coupling groove 215*b* formed in the key installation unit 210.

The stopper 320 is inserted into the installation hole 210 avoiding the regulator 213, and protrudes from the surface of the installation guide members 200 in which the consumables 100 are installed. The stopper 320 is formed to represent four modes with respect to the regulator 213 in order to identify the installation location of the first to fourth developing units 110Y, 110M, 110C and 110K. Referring to FIG. 3, the stopper 320 may include first to third stoppers 321, 323 and 325 to provide four modes. The first stopper 321 is formed from an end part of a first side of the coupler 310 to a transverse direction of an arrow direction A, accounting for approximately ¾ of the first side of the coupler 310. Accordingly, approximately ¼ of a second end part of the first side of the coupler 310 is open. The second stopper 323 is formed from the end part of a second side of the coupler 310 to the transverse direction of the arrow direction A, accounting for approximately ¾ of the second side in the opposite direction of the first stopper 321. The third stopper 325 is formed from the second side of the coupler 310 to the transverse direction of the arrow direction A, accounting for approximately ¼ of the second side in the opposite direction of the first stopper 321 so that it is spaced from the second stopper 323 as much as approximately ¼ thereof. In installing the irregular installation preventing keys 300 and the key installation unit 210 in the same shape, regulation locations may differ in each color by the location of the regulator 213 and the shape of the stoppers 320.

As shown in FIGS. 4A to 4D, irregular installation may be prevented by setting the coupling relationship between the irregular installation preventing keys 300Y, 300M, 300C and 300K and the first to fourth installation guide members 200Y, 200M, 200C and 200K.

In the present exemplary embodiment, the first to third stoppers 321, 323 and 325 are provided as an example of the stopper, but the stopper is not limited thereto. Alternatively, there may be other various examples depending on necessary modes.

FIGS. 5A to 5D are rear enlarged views of the area IV in FIG. 3 illustrating the coupling relationship between the key installation unit 210 formed in the installation guide members 200 and the irregular installation preventing keys 300 in each color.

As shown therein, the key installation unit 210 may further include an identification unit 250. The identification unit 250 is formed in a surface 210 of the installation guide members 200 (ex. Lower surface 210 in FIG. 3) in which the irregular installation preventing keys 300 are installed, to identify the installation direction of the irregular installation preventing keys 300 for each of the plurality of consumables by the naked eye. Since the key installation unit 210 further includes the identification unit 250, a user may efficiently identify and install the irregular installation preventing keys 300 more efficiently with respect to the installation guide members 200.

Figure 6:
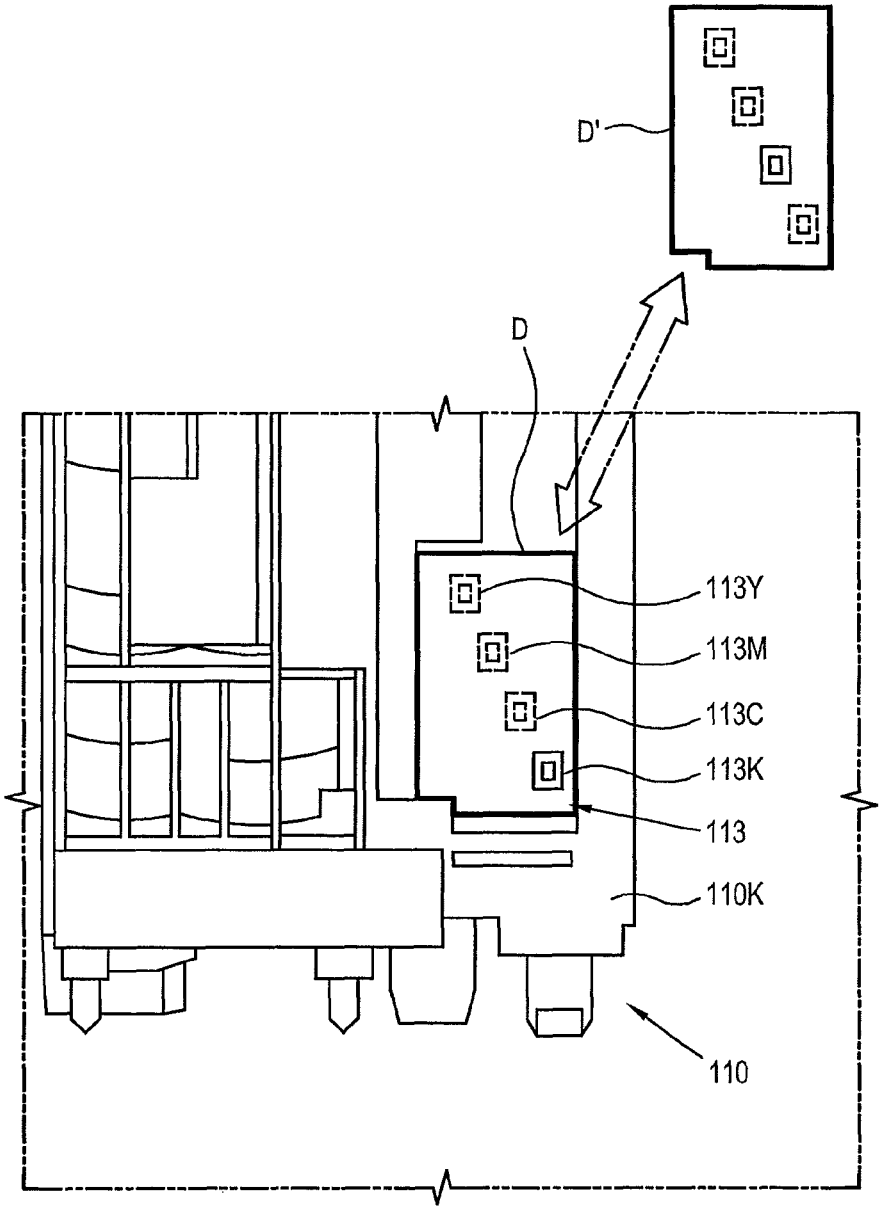
FIG. 6 is a bottom view of a part of a developing unit of the image forming apparatus according to the exemplary embodiment.
Figure 7A:
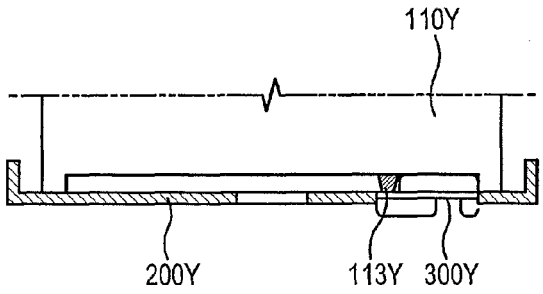
FIGS. 7A to 7D are partial sectional views illustrating an interaction between the irregular installation preventing unit and the irregular installation preventing key of the developing unit in FIG. 2.
Figure 7B:
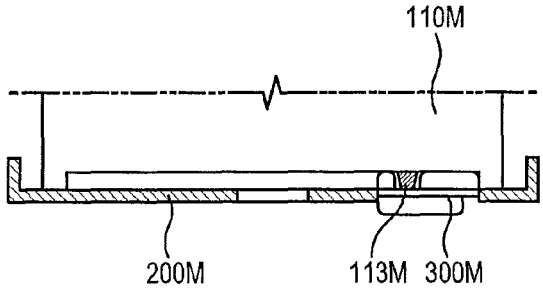
Figure 7C:
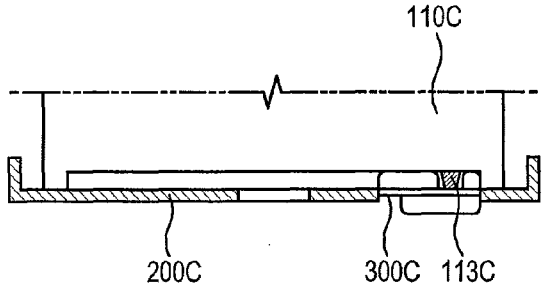
Figure 7D:
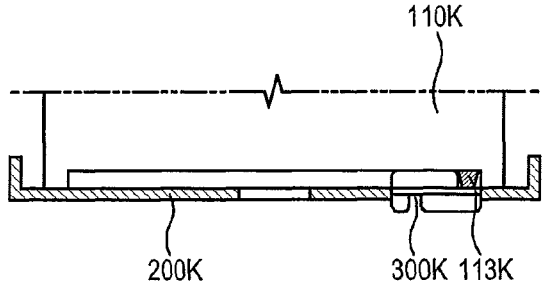

FIG. 6 is a bottom view of a part of the developing unit 110 of the image forming apparatus according to the exemplary embodiment of the present invention. FIG. 6 illustrates the fourth developing unit 110K as an example of the developing unit 110. Referring to FIG. 6, the irregular installation preventing units 113 are formed in different locations in each color on the lower surface of the developing unit 110 facing the installation guide members 200 in FIG. 2. In case of the fourth developing unit 110K, the irregular installation preventing unit 113K is formed in the location indicated in a solid line. In case of other developing units, the irregular preventing units 113Y, 113M and 113C are formed in locations indicated in dotted lines. The irregular installation preventing unit is expressed in a dotted line for purposes of convenience, and it is not formed in the fourth developing unit 110K.

Except for the irregular installation preventing units 113, the housing of the first to fourth developing units 110Y, 110M, 110C and 110K may have the same shape. Accordingly, if a plurality of cores which is formed in different locations corresponding to the irregular installation preventing units 113 is used to manufacture the housing the developing units 110Y, 110M, 110C and 110K, the housing of the plurality of developing units 110Y, 110M, 110C and 110K may be formed by a single mold. In FIG. 6, if the third developing unit 110C is to be manufactured by the same mold, a corresponding core applies to the mold, and the location D of the irregular installation preventing units 113 indicated in a bold line may be changed to D'. If the developing units 110Y, 110M, 110C and 110K in each color are manufactured by a single mold, the mold costs may be saved. In the present exemplary embodiment, the housing of the developing unit 110 is provided as an example of consumables 100 manufactured by a single mold, but not limited thereto. Alternatively, a housing of a toner storage unit may be manufactured by a single mold.

FIGS. 7A to 7D are partial sectional views illustrating an interaction between the irregular installation preventing units 113 and the irregular installation preventing keys 300 of the developing unit 110 in each color in FIG. 2.

As described with reference to FIGS. 2 to 6, the irregular installation preventing units 113 are formed in each color and the irregular installation preventing keys 300 are installed in the location of the installation guide members 200 to thereby match the irregular installation preventing units 113 and the irregular installation preventing keys 300 in each color and to prevent the irregular installation of the consumables 100 in each color.

In the structure for installing the consumables according to the exemplary embodiment, the irregular installation preventing keys 300 are installed on the plate surface of the installation guide members 200, and the interaction location of the consumables and the irregular installation preventing structure may be set freely. If the plurality of consumables is slidably coupled to the installation guide members 200, the irregular installation preventing units 113 and the irregular installation preventing keys 300 may interact only when the center of gravity of the plurality of consumables is located on the installation guide members 200. Thus, falloff and damage of the consumables due to irregular installation of consumables or risk of damage to the rear end of the consumables due to forced insertion may be fundamentally prevented.

As described above, a structure for installing consumables of an image forming apparatus and an image forming apparatus applying the same according to the embodiments has irregular installation preventing keys formed in the substantially same shape and enables a manufacturer to manufacture the irregular installation preventing keys by a single mold. Thus, manufacturing costs for irregular installation preventing structures may be reduced.

Also, a structure for installing consumables of an image forming apparatus and an image forming apparatus applying the same according to the embodiments has an identification unit to identify, by the naked eye, an installation location of irregular installation preventing keys with respect to installation guide members guiding the installation of consumables and reduces errors in installing the irregular installation preventing keys.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. A structure for installing consumables of an image forming apparatus, the structure comprising:

a frame;

a plurality of consumables which comprises irregular installation preventing units in different locations;

a plurality of installation guide members which is installed in the frame;

a plurality of key installation units which is provided in the installation guide members and located in positions corresponding to the irregular installation preventing units, respectively; and a plurality of irregular installation preventing keys which is coupled to the key installation units in the corresponding positions and matched with the corresponding irregular installation preventing units, respectively.

2. The structure according to claim 1, wherein the plurality of irregular installation preventing keys has the same shape, and differs in an irregular installation preventing location depending on a coupling direction of the irregular installation preventing keys with respect to the key installation unit, and the key installation unit guides the plurality of irregular installation preventing key to be matched in different orientations for each of the consumables.

3. The structure according to claim 2, wherein the key installation unit comprises:

an installation hole formed in the installation guide member in a transverse direction of an installation direction of the consumables; and a regulator which is formed in different locations of the installation guide member for each of the plurality of consumables and regulates the coupling direction of the irregular installation preventing keys.

4. The structure according to claim 3, wherein the key installation unit further comprises an identification unit which is formed in a surface of the installation guide member in which the irregular installation preventing keys are coupled, and identifies the coupling direction of the irregular installation preventing keys for the plurality of consumables.

5. The structure according to claim 3, wherein the irregular installation preventing keys comprise a stopper which inserted in the installation hole avoiding the regulator and formed on a surface of the installation guide member in which the consumables are installed, and prevents an irregular installation of the plurality of consumables.

6. The structure according to claim 1, wherein the plurality of consumables comprises a plurality of developing units which is classified by color and differs in an installation location or a plurality of developing cartridges which is classified by color and differs in an installation location.

7. The structure according to claim 6, wherein a plurality of cores which is formed in different locations corresponding to the irregular installation preventing unit is used to form a housing of the plurality of developing units or a housing of the plurality of developing cartridges by a single mold.

8. The structure according to claim 1, wherein an installation location of the irregular installation preventing unit with respect to the consumables and an installation location of the key installation unit with respect to the installation guide member are determined to enable the irregular installation preventing unit and the irregular installation preventing keys to interact after the center of gravity of the plurality of consumables is located on the installation guide member.

9. The structure according to claim 2, wherein the irregular installation preventing key comprises a coupler which is coupled to a surface of the key installation unit to be parallel with a plate surface of the installation guide member.

10. The structure according to claim 9, wherein the key installation unit comprises a coupling groove which is formed corresponding to the coupler of the irregular installation preventing key.

11. An image forming apparatus comprising:

a frame;

a plurality of developing units which comprises an irregular installation preventing unit in different locations and forms a visible image on an image carrier;

a plurality of installation guide members which is installed in the frame;

a plurality of key installation units which is provided in the installation guide members and located in positions corresponding to the irregular installation preventing units, respectively; and a plurality of irregular installation preventing keys which is coupled to the key installation units in the corresponding positions and matched with the corresponding irregular installation preventing units, respectively.

12. The image forming apparatus according to claim 11, wherein the plurality of irregular installation preventing keys has the same shape, and differs in an irregular installation preventing location depending on a coupling direction of the irregular installation preventing keys with respect to the key installation unit, and the key installation unit guides the plurality of irregular installation preventing key to be matched in different orientations for each of the developing units.

13. The image forming apparatus according to claim 12, wherein the key installation unit comprises:

an installation hole which is formed in the installation guide member in a transverse direction of the installation direction of the developing unit; and a regulator which is formed in different locations of the installation guide member for each of the plurality of developing units and regulates the coupling direction of the irregular installation preventing keys.

14. The image forming apparatus according to claim 13, wherein the key installation unit further comprises an identification unit which is formed in a surface of the installation guide member in which the irregular installation preventing keys are coupled, and identifies the coupling direction of the irregular installation preventing keys for each of the plurality of developing units.

15. The image forming apparatus according to claim 13, wherein the irregular installation preventing keys comprise a stopper which is inserted into the installation hole avoiding the regulator and formed on a surface of the installation guide member in which the developing units are installed, and prevents the irregular installation of the plurality of developing units.

16. The image forming apparatus according to claim 11, wherein a plurality of cores which is formed in different locations corresponding to the irregular installation preventing unit is used to form a housing of the plurality of developing units by a single mold.

17. The image forming apparatus according to claim 11, wherein the installation location of the irregular installation preventing unit with respect to the developing unit and the installation location of the key installation unit with respect to the installation guide member are determined to enable the irregular installation preventing unit and the irregular installation preventing keys to interact after the center of gravity of the plurality of developing units is located in the installation guide member.

18. The image forming apparatus according to claim 12, wherein the irregular installation preventing key comprises a coupler which is coupled to a surface of the key installation unit to be parallel with a plate surface of the installation guide member.

19. The image forming apparatus according to claim 18, wherein the key installation unit comprises a coupling groove which is formed corresponding to the coupler of the irregular installation preventing key.

* * * * *

UNITED STATES PATENT AND TRADEMARK OFFICE

CERTIFICATE OF CORRECTION

PATENT NO. : 8,818,237 B2
APPLICATION NO. : 14/075724
DATED : August 26, 2014
INVENTOR(S) : Byung-jo Lee et al.

It is certified that error appears in the above-identified patent and that said Letters Patent is hereby corrected as shown below:

On the Title Page

Item [71] (Applicant), Column 1, Line 1, Delete "Samung" and insert -- Samsung --, therefor.

Signed and Sealed this
Eighteenth Day of November, 2014

Michelle K. Lee

Michelle K. Lee
*Deputy Director of the United States Patent and Trademark Office*